US006669191B2

(12) United States Patent
Lee

(10) Patent No.: US 6,669,191 B2
(45) Date of Patent: Dec. 30, 2003

(54) SHEET DELIVERY AND POSITION CONTROLLING APPARATUS FOR A PRINTER

(75) Inventor: Seung-Jae Lee, Suwon (KR)

(73) Assignee: Samsung Electronics Co., Ltd., Kyungki-do (KR)

( * ) Notice: Subject to any disclaimer, the term of this patent is extended or adjusted under 35 U.S.C. 154(b) by 128 days.

(21) Appl. No.: 10/105,295

(22) Filed: Mar. 26, 2002

(65) Prior Publication Data

US 2003/0006547 A1 Jan. 9, 2003

(30) Foreign Application Priority Data

Jul. 5, 2001 (KR) ..... 2001-39919

(51) Int. Cl.[7] ..... B65H 29/54
(52) U.S. Cl. ..... 271/189; 271/188; 271/306
(58) Field of Search ..... 271/306, 182, 271/188, 189, 200; B65H 29/54, 29/68, 29/70, 29/34, 29/50

(56) References Cited

U.S. PATENT DOCUMENTS 4,488,633 A * 12/1984 Kampf ..... 198/341.08
5,536,000 A * 7/1996 Kelly ..... 271/189
5,603,493 A * 2/1997 Kelly ..... 271/188
5,648,807 A * 7/1997 Saito et al. ..... 347/102
6,042,106 A * 3/2000 Kelly et al. ..... 271/188
6,092,948 A * 7/2000 Altfather ..... 400/625

FOREIGN PATENT DOCUMENTS

JP 2001-253630 * 9/2001 ..... B65H/31/32

* cited by examiner

*Primary Examiner*—Donald P Walsh
*Assistant Examiner*—Kenneth W Bower
(74) *Attorney, Agent, or Firm*—Robert E. Bushnell, Esq.

(57) ABSTRACT

Disclosed is a sheet delivery and position controlling apparatus for an ink jet printer. The sheet delivery and position controlling apparatus includes a sheet discharging unit having a sheet delivery roller for discharging in sequence printed sheets to a sheet stacker, a delay unit having a swivel unit pivotally provided between the sheet delivery roller and the sheet stacker for movable between a first position which does not interfere with the sheet discharged from the sheet delivery roller and a second position which interferes with the sheet discharged from the sheet delivery roller to delay a time period to be placed on the sheet stacker after the printed sheets are discharged, a driving motor, a power transmission unit for transmitting power from the driving motor to the swivel unit to selectively swivel the swivel unit to the first position and the second position, and a control unit for controlling the operation of the driving motor.

24 Claims, 4 Drawing Sheets

SHEET DELIVERY AND POSITION CONTROLLING APPARATUS FOR A PRINTER

CLAIM OF PRIORITY

This application makes reference to, incorporates the same herein, and claims all benefits accruing under 35 U.S.C. §119 from an application for APPARATUS FOR PAPER FEEDING AND CONTROL OF FEEDING POSITION FOR INK-JET PRINTER earlier filed in the Korean Industrial Property Office on Jul. 5, 2001, and there duly assigned Serial No. 39919/2001 by that Office.

BACKGROUND OF THE INVENTION

1. Field of the Invention

The present invention relates to a printer, and more particularly, to a sheet delivery and position controlling apparatus for a printer which controls delivery and position of a printed sheet of paper discharged from the printer.

2. Description of the Related Art

In general, an ink jet printer is often required to successively print numerous sheets of paper. In this case, a first printed sheet is discharged into a sheet stacker through a discharging unit having a feeding roller and a discharging roller. Then, next printed sheet following the first printed sheet is successively discharged and dropped down on the top surface of the first printed sheet which has been already disposed on the sheet stacker.

Meanwhile, when the next printed sheet is discharged and placed on the top surface of the first printed sheet before a portion of ink material formed on the top surface of the first printed sheet is dried out, the next discharged printed sheet is stained or blurred with the ink material of the first printed sheet. In this case, a printing image formed by the ink material on the first printed sheet is damaged as well as the next printed sheet is stained with the ink material. Accordingly, printed images of both of the first and next printed sheets may be defective as a drawback. Therefore, it is disadvantageous that the printer is required an extended period of time for discharging the next printed sheet until the ink material of first printed sheet is dried out.

SUMMARY OF THE INVENTION

It is an object of the present invention to provide a sheet delivery and position controlling apparatus for an ink jet printer discharging a first printed sheet and a second printed sheet following the first printed sheet and extending a period of time for the second printed sheet to contact the first printed sheet once the second printed sheet is discharged.

It is another object to provide a sheet delivery and position controlling apparatus able to prevent the second printed sheet from being stained by wet ink material formed on the first printed sheet.

It is still another object to provide a delivery and position controlling apparatus able to prevent the first printed sheet from being damaged when the second printed sheet is discharged onto the first printed sheet.

It is yet another object to provide a delivery and position controlling apparatus able to maintain image quality formed on each printed sheet.

These and other objects may be achieved by providing a sheet delivery and position controlling apparatus for an inkjet printer including a sheet stacker, a dischargingunit having a sheet delivery roller for discharging in sequence printed sheets to the sheet stacker, and a delay unit having a swivel unit pivotally provided between the sheet delivery roller and the sheet stacker to move between a first position which does not interfere with the printed sheet discharged from the sheet delivery roller and a second position which interferes with the printed sheet discharged from the sheet delivery roller to delay the printed sheet placed on the sheet stacker by a predetermined period of time, a driving motor, a power transmission unit for transmitting power from the driving motor to the swivel unit to selectively swivel the swivel unit to the first position and the second position, and a control unit for controlling the operation of the driving motor.

The power transmission unit includes a driven gear coupled to the swivel center of the swivel unit to be swiveled together therewith, a worm gear provided to a shaft of the driving motor for being rotated perpendicular to a direction of rotation of the driven gear, and a clutch installed between the worm gear and the driven gear for transmitting power from the worm gear to the driven gear and controlling power transmitted to the driven gear to control the position of the swivel unit.

The clutch includes a worm wheel gear geared to the worm gear, a clutch shaft coupled to the center of rotation of the worm wheel gear for being rotated therewith, and being provided at one end with an inclined portion extended in diameter, a clutch gear provided to the clutch shaft for being cooperative to the driven gear and having a shaft hole inclined corresponding to the inclined portion, and a spring for elastically forcing the clutch gear toward the inclined portion to create a friction force between the inclined portion and the shaft hole.

The swivel unit includes a pair of swivel arms, a connecting members for connecting the pair of swivel arms, and guide members provided in the connecting member at an interval for guiding the sheet as contacting the underside thereof discharged by the sheet delivery roller at the second position.

The sheet delivery and position controlling apparatus of the present invention includes a stopper for limiting the moving range of the swivel arm displaced to the second position.

BRIEF DESCRIPTION OF THE DRAWINGS

A more complete appreciation of the present invention, and many of the attendant advantages, thereof, will be readily apparent as the same becomes better understood by reference to the following detailed description when considered in conjunction with the accompanying drawings in which like reference symbols indicate the same or similar components, wherein.

DESCRIPTION OF THE PREFERRED EMBODIMENT

Figure 1:
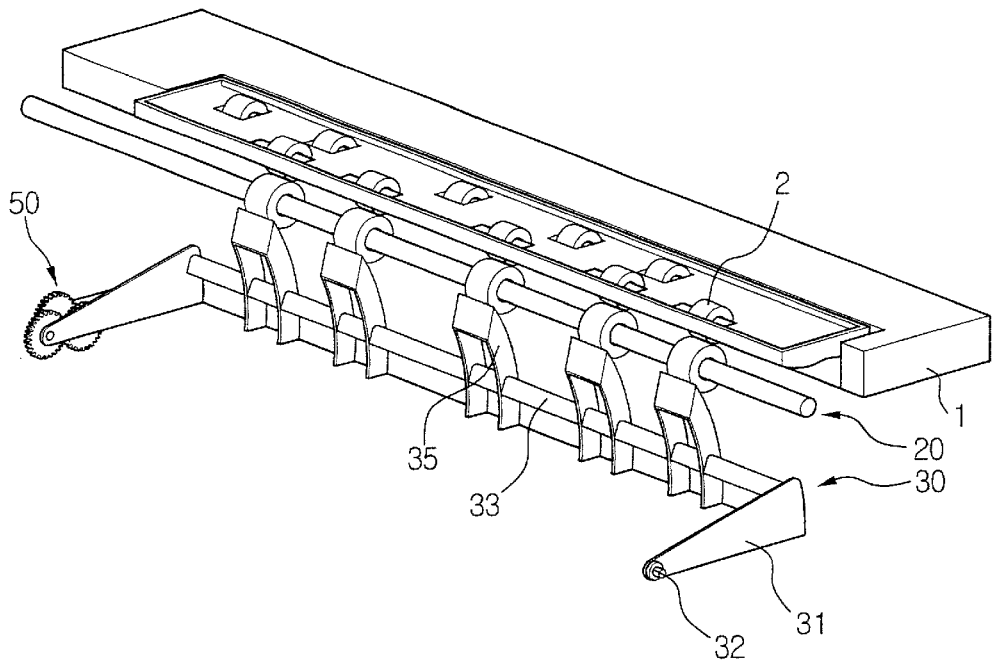
FIG. 1 is a perspective view for showing a sheet delivery and position controlling apparatus for an ink jet printer constructed according to the present invention.
Figure 2:
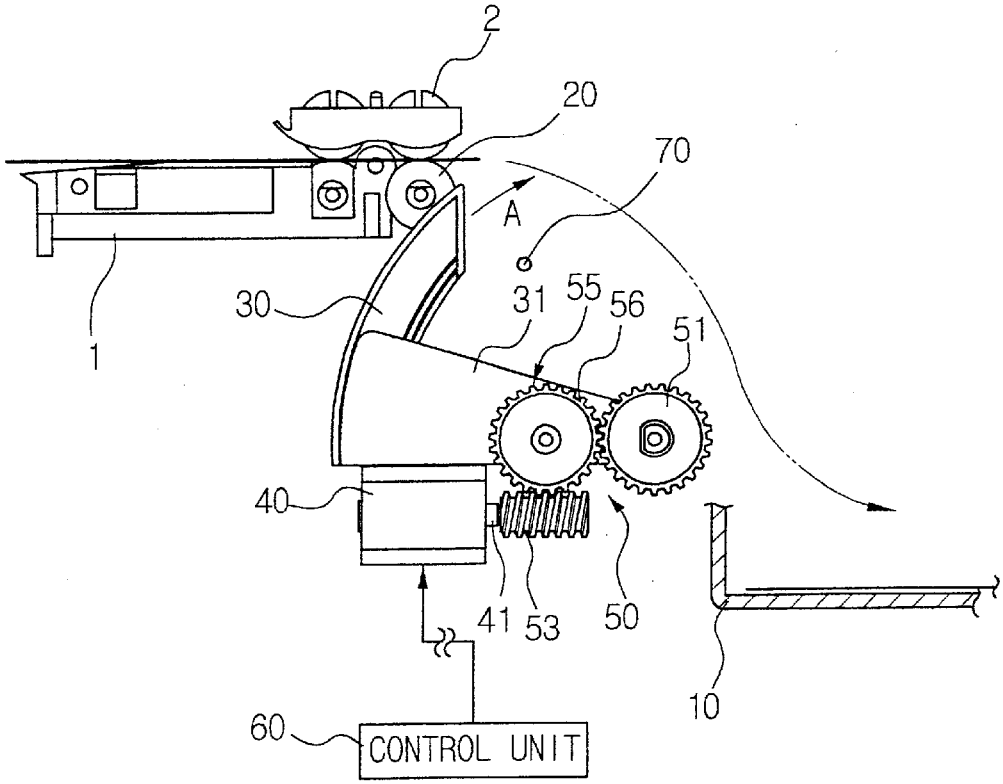
FIG. 2 is a side elevation view for showing a sheet delivery and position controlling apparatus for an ink jet printer.

Turning now to the drawings, FIGS. 1 and 2 show a sheet delivery and position controlling apparatus for an ink jet printer including a sheet stacker 10, a discharging unit having a delivery roller 20 for discharging printed sheets in sequence to sheet stacker 10, and a delay unit having a swivel unit 30 arranged between sheet delivery roller 20 and sheet stacker 10, a driving motor 40, a power transmission unit 50 for transmitting power from driving motor 40 to swivel unit 30 and a control unit 60 for controlling operation of the driving motor 40.

Sheet delivery roller 20 is disposed on a side of a sheet discharging port of a printer body (not shown) of the ink jet printer. Sheet delivery roller 20 is rotationally supported to a supporting bracket 1 and rotates by a driving source (not shown). Further, sheet delivery roller 20 rotates to contact an idle roller 2 so that the printed sheets are discharged from the discharging port to sheet stacker 10. Since idle roller 2 is pushed against delivery roller 20 with a certain pressure, the printed sheets passing through sheet delivery roller 20 and idle roller 2 are discharged in a substantially horizontal direction and then in a sheet discharging direction.

Sheet stacker 10 sequentially receives the printed sheets discharged by sheet delivery roller 20. Sheet stacker 10 is placed downstream the sheet discharging direction of the printed sheets.

Swivel unit 30 is pivotally installed between sheet delivery roller 20 and sheet stacker 10. Swivel unit 30 moves between the first position which does not interfere with the sheet discharged from the discharging port and the second position which interferes with the same. When swivel unit 30 disposed in the first position as shown in FIG. 2, is swiveled to the direction of an arrow A, swivel unit 30 is displaced to the second position.

Swivel unit 30 includes a pair of swivel arms 31, a connecting member 33 for connecting between the pair of swivel arms 31, and guide members 35 provided on connecting members 33 at a certain interval. Swivel arms 31 are coupled at one ends to the printer body via hinges 32 while swivel arms 31 are connected at the other ends with connecting member 33.

Guide members 35 contacts a bottomside of the printed sheet discharged by sheet delivery roller 20 when swivel unit 30 is positioned at the second position. Therefore, the printed sheet stays between the discharging port and sheet stacker 10 for a longer period of time before the printed sheet is placed on sheet stacker 10 since the printed sheet is guided by guide members 35. Such guide members 35 are provided in plural, and each of the guide members has a round shape. Therefore, the discharged printed sheet contacts guiding members 35 in a normal direction.

Power transmission unit 50 includes a driven gear 51 coupled to one end of swivel arm 31 or the swiveling center, a worm gear 53 installed in a shaft 41 of driving motor 40, and a clutch 55 for controlling and transmitting power transmitted to worm gear 53 to driven gear 51. Driven gear 51 is fixed to hinge 32 of swivel arm 31 and rotated together therewith. Therefore, driving motor 40 is preferably arranged perpendicular to a direction of rotation of driven gear 51.

Figure 3:
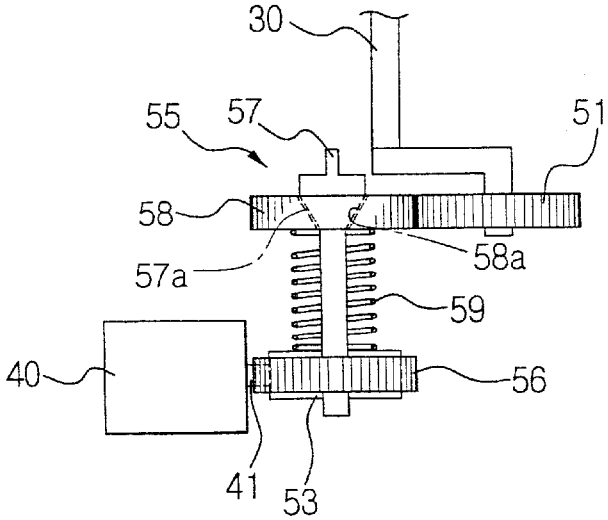
FIG. 3 is a plan view for schematically showing a delay unit of in FIG. 2.

Clutch 55 is installed between worm gear 53 and driven gear 51. Further, clutch 55 transmits power from worm gear 53 to driven gear 51 while controlling the magnitude of transmitted power so as to control the swiveling range of swivel unit 30. Clutch 55, as shown in FIG. 3, includes a worm wheel gear 56 gear-connected to worm gear 53, a clutch shaft 57 coupled to the center of rotation of worm wheel gear 56, a clutch gear 58 installed in clutch shaft 57, and a spring 59.

Worm wheel gear 56 is installed perpendicular to an axis of worm gear 53 so as to change power from worm gear 53 in an angle of about 90 degree. Worm wheel gear 56 is rotated together with clutch shaft 57 fixed to a center thereof. Clutch shaft 57 is provided at one end with an inclined portion gradually extended in diameter. Clutch gear 58 is installed in clutch shaft 57 to be positioned between worm wheel gear 56 and inclined portion 57*a*. Clutch gear 58 has a shaft hole 58*a* inclined to have a shape corresponding to inclined portion 57*a*. Clutch gear 58 is engaged with driven gear 51.

Spring 59 is installed between clutch gear 58 and worm wheel gear 56 to bias clutch gear 58 toward inclined portion 57*a*. Therefore, a spring force of spring 59 generates friction force between inclined portion 57*a* and shaft hole 58*a*. Under the friction force, clutch gear 58 can be transmitted with power from clutch shaft 57 and thus rotated. Also, when swivel unit 30 is applied with a load larger than the friction force, clutch gear 58 fails to receive power from clutch shaft 57, but performs a sliding movement.

Control unit 60 controls the operation of driving motor 40 based upon information about the sequence and the discharging speed of the printed sheets discharged by sheet delivery roller 20. Control unit 60 is coupled to a main controller (not shown) in the printer to receive a signal representing of the number of sheets to be printed. Control unit 60 controls driving motor 40 to move swivel unit 30 in the first or second positions in accordance with the signal. If the signal represents that only one sheet is printed, driving motor 40 moves swivel unit 30 in the first position. If the signal represents that more than two sheets are printed, swivel unit 30 is moved to the second position after a first printed sheet is discharged.

Meanwhile, preferably, a stopper 70 is further provided to limit the moving range of swivel unit 30 when swivel unit 30 moves to the second position. Therefore, when swivel unit 30 is stopped by stopper 70, a load is applied to swivel unit 30. Due to the load applied to swivel unit 30, clutch gear 58 coupled to swivel unit 30 slides about clutch shaft 57 and thus does not transmit power to driven gear 51 as shown above. As a result, it can be prevented that the load is applied to driving motor 40.

The operation of the sheet delivery and position controlling apparatus for an ink jet printer configured as above according to the embodiment of the invention will be described as follows.

When a number of sheets are printed in succession, swivel unit 30 is placed at the first position as shown in FIG. 2. Then, the first printed sheet discharged by sheet delivery roller 20 is directly stacked on sheet stacker 10 without being interfered by swivel unit 30. Right after the first printed sheet is discharged, control unit 60 controls and starts driving motor 40. When driving motor 40 is started, power is transmitted to worm wheel gear 56 and clutch shaft 57 via worm gear 53. In this case, clutch gear 58 is rotated together by the friction force created between clutch shaft 57 and clutch gear 58 by the biased force caused by spring 59. Power transmitted to clutch gear 58 is transmitted to driven gear 51, and swivel unit 30 is swiveled in the direction of the arrow A.

Figure 4:
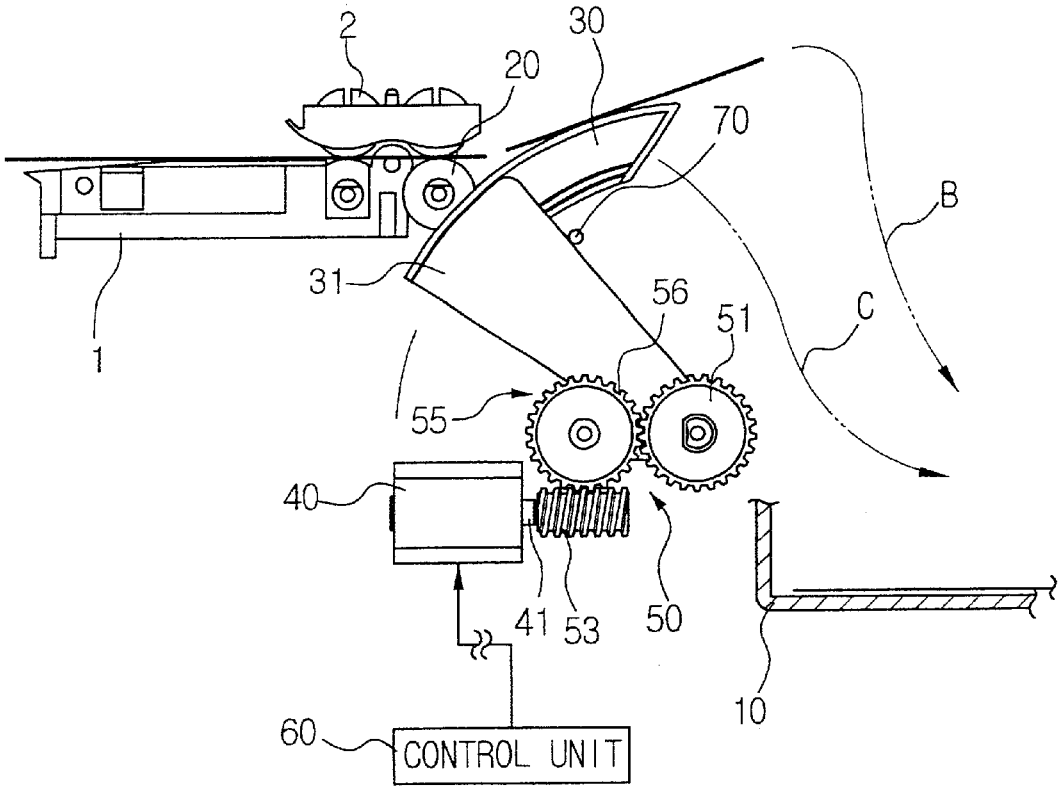
FIG. 4 is a side elevation view for showing the operation of the sheet delivery and position controlling apparatus for an ink jet printer shown in FIG. 1.

When swiveled in a certain degree, swivel unit 30 is stopped by stopper 70 at the second position, as shown in FIG. 4, and is not swiveled further. In this second position, the load applied to swivel unit 30 by stopper 70 is larger than the friction force generated between inclined portion 57*a* and shaft hole 58*a*. Therefore, even if driving motor 40 is successively operated, power from clutch shaft 57 is not transmitted to clutch gear 58. In other words, clutch gear 58 is stopped, whereas only clutch shaft 57 is rotated freely. Therefore, even if control unit 60 may not precisely control the operation of driving motor 40, it is prevent that driving motor 40 is overheated due to the load.

Meanwhile, swivel unit 30 is placed at the second position, guide members 35 provided on swivel unit 30 is positioned to interfere with the discharged printed sheet. Therefore, the successively discharged printed sheets including the second sheet are guided by guide member 35 at a position substantially higher than a horizontal position until the printed sheets drop down to be stacked on sheet stacker 10. Referring to FIG. 4, a first path of the discharged printed sheet without being guided by guide member 35 is designated as C, and a second path of the discharged printed sheet guided by guide member 35 is designated as B. In other words, comparing the second path B to the first path C, the second path B shows the extended period of time required for the printed sheet to be discharged and stacked on sheet stacker 10. Therefore, in the case of successive printing, when the ink material on the first printed sheet is not dried out yet, the time period for the next discharged printed sheet to be placed on the first discharged printed sheet is extended until the wet ink of the first discharged printed sheet is dried. Further, it is unnecessary to ensure an additional drying time period for drying the wet ink material so that high speed printing operation can be achieved.

Further, even if driving motor 40 is stopped where swivel unit 30 is positioned at the second position, it can be restricted that swivel motor 30 returns to the first position under self-weight. In other words, the friction force generated by the biased force of spring 59 restricts rotation of clutch gear 58, and secondly worm wheel gear 56 is geared substantially perpendicular to worm gear 53 to prevent free rotation of worm wheel gear 56, so that swivel unit 30 can be maintained at the second position. Therefore, in the case of successive printing, after being operated for a while to move swivel unit 30 to the second position, driving motor 40 can be maintained as stopped. Therefore, power required for swiveling swivel unit 30 and maintaining the position thereof can be reduced.

Figure 5:
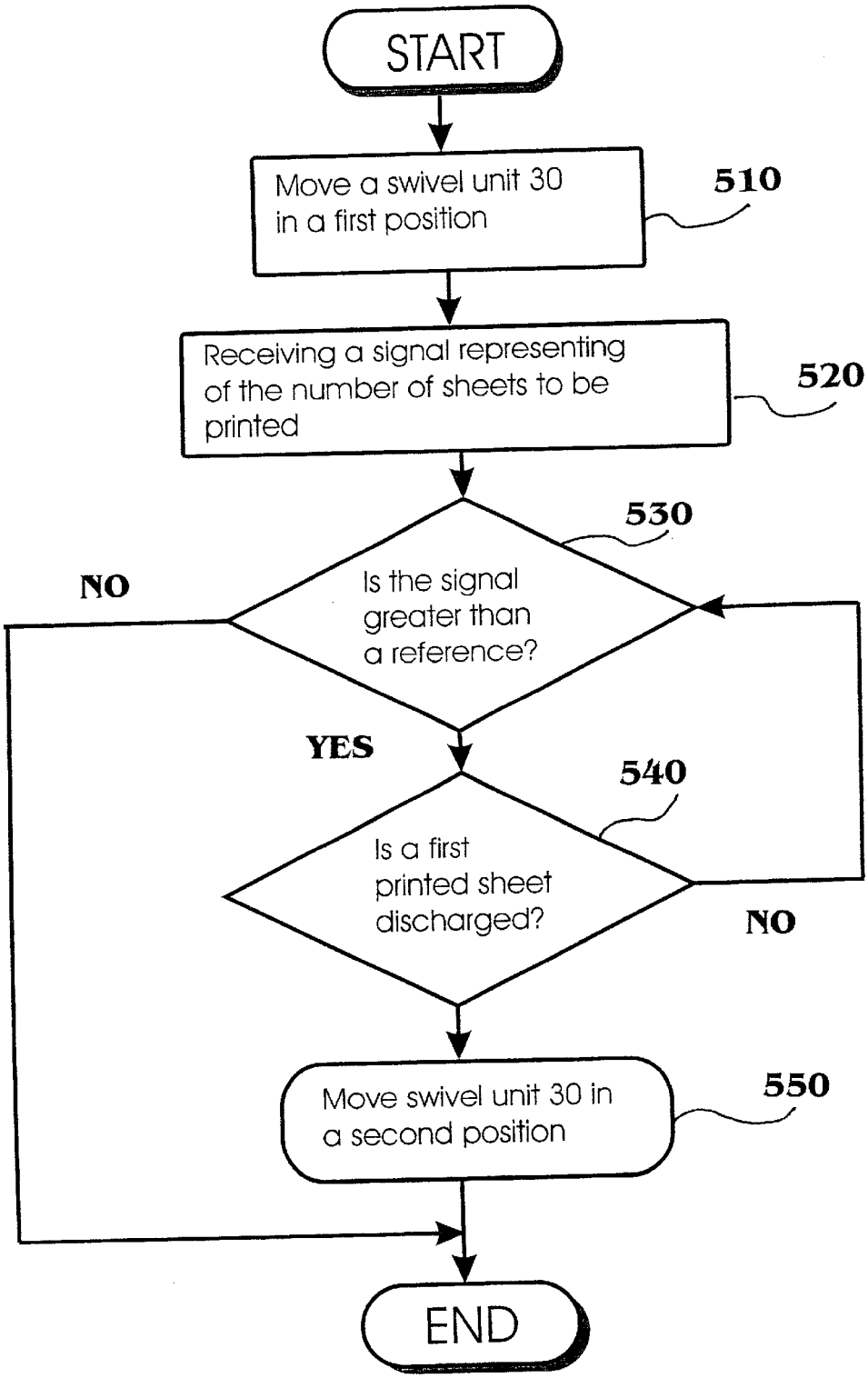

In FIG. 5, when swivel unit 30 is disposed in the first position in step 510, a signal representing the number of sheets to be printed or one of high speed operations for printing a number of sheets is fed from the main controller of the printer to control unit 60 in step 520. If a reference is 1 and the signal represents more than 2 in step 530, swivel unit 30 moves in the second position in step 550 after a first printed sheet is discharged in step 540.

Meanwhile, the printing operation is over, driving motor 40 rotate in a reverse direction to place swivel unit 30 to the first position.

According to the sheet delivery and position controlling apparatus for an ink jet printer of the invention as described hereinbefore, the time period required for the next printing sheet to reach the preceding printing sheet can be extended. Therefore, the additional delay time period is omitted after the preceding sheet is printed so that high speed printing and stable image quality can be obtained. Further, the position of the swivel unit is controlled by using the clutch so that the swivel unit can be return-prevented and position-controlled using a simple system.

What is claimed is:

1. A sheet delivery and position controlling apparatus in a printer, comprising:

a sheet delivery roller for discharging in sequence printed sheets to a sheet stacker along a path;

a swivel unit pivotally provided between said sheet delivery roller and said sheet stacker for movable between a first position which does not interfere with the sheet discharged from said sheet delivery roller and a second position which interfere with the sheet discharged from said sheet delivery roller to extending said path by a predetermined amount, said swivel unit being a single integrated monolithic unit;

a driving motor;

a power transmission unit for transmitting power from said driving motor to said swivel unit to selectively swivel said swivel unit to said first position and said second position; and a control unit for controlling said driving motor to generate said power.

2. The apparatus of claim 1, said power transmission unit including:

a driven gear coupled to a swivel shaft of said swivel unit to be swivelled together therewith;

a worm gear coupled to a worm shaft of said driving motor, having an axis perpendicular to said driven gear; and a clutch installed between said worm gear and said driven gear for transmitting power from said worm gear to said driven gear and controlling said power transmitted to said driven gear to control the movement of said swivel unit.

3. The apparatus of claim 2, said clutch including:

a worm wheel gear engaged with said worm gear;

a clutch shaft coupled to said worm wheel gear being provided at one end with a first inclined portion;

a clutch gear disposed around said one end of said clutch shaft, engaged with said driven gear, having a shaft hole defined by a second inclined portion corresponding to said inclined portion of said clutch shaft; and a spring for elastically forcing said clutch gear toward said first inclined portion of said clutch shaft to create a friction force between said first inclined portion of said clutch shaft and said second inclined portion of said clutch gear.

4. The apparatus of claim 1, said swivel unit including:

a pair of swivel arms spaced-apart from each other;

a connecting member for connecting said pair of swivel arms; and guide members provided on said connecting member at an interval for guiding the sheet as contacting a bottom side of said sheet discharged from said delivery roller at the second position.

5. The apparatus of claim 1, further comprising a stopper formed on said printer for limiting a moving range of said swivel arm disposed on said second position.

6. An apparatus in a printer, comprising:

a sheet discharging unit disposed within said printer to discharge a sheet of paper outside said printer through a discharging port;

a sheet stacker coupled to said printer and disposed to receive said sheet discharged from said discharging port of said sheet discharging unit; and a delay unit disposed between said sheet discharging unit and said sheet stacker, said delay unit being movable between a first and a second position, said delay unit guiding said sheet to be discharged from said discharging port of said sheet discharging unit into said sheet stacker along either a first or a second discharging path depending on whether said delay unit is in said first or said second position, said second discharging path being greater than said first discharging path in terms of length.

7. The apparatus of claim 6, said delay unit not contacting said sheet in said first position while contacting said sheet in said second position in order to form said second discharging path.

8. The apparatus of claim 6, said delay unit contacting said sheet discharged along said second discharging path while said delay unit does not contact said sheet discharged along said first discharging path.

9. The apparatus of claim 6, said delay unit disposed on said first discharging path to guide said sheet discharged from said sheet discharging unit to be received by said sheet stacker along said second discharging path.

10. The apparatus of claim 6, said delay unit disposed between said discharging port and said sheet stacker to allow said sheet to be discharged along said first discharging path while said delay unit is disposed in a position higher than said discharging port to guide said sheet to be discharged along said second discharging path.

11. The apparatus of claim 6, said delay unit including a swivel unit rotating about a swivel shaft to a first position for allowing said sheet to be discharged along said first discharging path and to a second position for guiding said sheet to be discharged along said second discharging path.

12. The apparatus of claim 6, said apparatus further comprising a main controller, said main controller being programmed and configured to cause said delay unit to move from said first position to said second position immediately after a discharge of a first sheet for a print job.

13. The apparatus of claim 6, said apparatus allowing a first sheet to be discharged along said first discharging path while guiding a second sheet successive to said first sheet to be discharged along said second discharging path.

14. The apparatus of claim 6, said delay unit including:

a swivel unit rotatably moving between a first position and a second position;

a driving motor;

a power transmission unit for transmitting power from said driving motor to said swivel unit to selectively swivel unit to said first position and said second position; and a control unit for controlling said driving motor to generate said power.

15. The apparatus of claim 14, said power transmission unit including:

a driven gear coupled to a swivel shaft of said swivel unit to be swivelled together with said swivel shaft;

a worm gear coupled to said driving motor; and a clutch disposed between said worm gear and said driven gear.

16. The apparatus of claim 15, said clutch including:

a worm wheel gear coupled to said worm gear;

a clutch shaft coupled to said worm wheel gear and having a first clutching position; and a clutch gear inserted around said first clutching portion, engaged with said driven gear, having a second clutching portion corresponding to said first clutching portion in shape.

17. The apparatus of claim 16, further comprising a spring disposed between said clutch gear and said worm wheel gear to bias said clutch gear against said first clutching portion of said clutch shaft.

18. The apparatus of claim 14, said swivel unit including:

a swivel arm;

a connecting member coupled to said swivel arm; and a guide member coupled to said connecting member for guiding said sheet to be discharged along said second discharging path.

19. The apparatus of claim 18, said guide member contacting a bottom of said sheet to guide said sheet to be discharged along said second discharging path.

20. The apparatus of claim 14, further comprising a stopper formed on said printer and contacting said swivel unit to limit a moving range of said swivel arm.

21. A process in a printer, comprising the steps of:

providing a sheet stack receiving a first sheet of paper in a print job discharged from a discharging port along a first discharging path;

providing a delay unit disposed between said discharging port and said sheet stacker to guide, said delay unit causing a second sheet of paper in said print job to be discharged along a second discharging path that is greater in length and in time than said first discharging path;

moving said delay unit to a first position causing said first sheet to be discharge along said first discharging path; and moving said delay unit to a second position causing said second sheet to be discharged along said second discharging path.

22. The process of claim 21, further comprising the step of keeping said delay unit in said second position for a remainder of said print job so that all remaining sheets of paper in said print job are discharged onto said sheet stack via said second discharging path.

23. A sheet delivery and position controlling apparatus in a printer, comprising:

a sheet delivery roller for discharging in sequence printed sheets to a sheet stacker along a path;

a swivel unit pivotally provided between said sheet delivery roller and said sheet stacker for movable between a first position which does not interfere with the sheet discharged from said sheet delivery roller and a second position which interfere with the sheet discharged from said sheet delivery roller to extending said path by a predetermined amount, said swivel unit having an axis that is parallel to a leading edge of said printed sheets;

a driving motor;

a power transmission unit for transmitting power from said driving motor to said swivel unit to selectively swivel said swivel unit to said first position and said second position; and a control unit for controlling said driving motor to generate said power.

24. A process in a printer, comprising the steps of:

providing a delay unit disposed between a sheet discharging port of a printer and a sheet stack, said delay unit being movable between a first position and a second position, wherein discharged sheets must travel a first and shorter path when said delay unit is in said first position and discharged sheets must travel a second and longer path when said delay unit is in said second position;

starting a new print job;

moving said delay unit to said first position causing a first sheet of said print job to be discharge along said first path; and moving said delay unit to said second position causing a second and subsequent sheets in said print job to be discharged along said second path.

* * * * *